United States Patent [19]

Tanaka

[11] Patent Number: 4,660,464

[45] Date of Patent: Apr. 28, 1987

[54] CLEAN AIR SUPPLY MEANS IN A CLEAN TUNNEL

[75] Inventor: Hirokuni Tanaka, Kourai Ooiso, Japan

[73] Assignee: Sanki Kogyo Kabushiki Kaisha, Tokyo, Japan

[21] Appl. No.: 771,223

[22] Filed: Aug. 30, 1985

[30] Foreign Application Priority Data

Sep. 3, 1984 [JP] Japan ..... 59-182735

[51] Int. Cl.[4] ..... F24F 7/10

[52] U.S. Cl. ..... 98/115.3; 55/385 A; 55/473; 98/34.5; 98/49; 98/115.2; 104/139; 118/326

[58] Field of Search ..... 98/1.5, 49, 34.5, 31.5, 98/115.2, 115.3, 119; 55/385 A, 470, 473; 118/326, 634, DIG. 7; 34/204, 217; 104/139

[56] References Cited

U.S. PATENT DOCUMENTS

| | | | |
|---|---|---|---|
| 2,528,087 | 10/1950 | Schoepe | 118/326 X |
| 2,737,879 | 3/1956 | Cooke et al. | 98/119 |
| 3,395,972 | 8/1968 | Hardison | 98/115.2 X |
| 3,487,766 | 1/1970 | Wood | 98/31.5 X |
| 3,630,138 | 12/1971 | Marcussen et al. | 98/1.5 |
| 4,266,504 | 5/1981 | Roesner | 118/326 X |
| 4,338,958 | 7/1982 | Fujita | 118/326 X |

FOREIGN PATENT DOCUMENTS

| | | | |
|---|---|---|---|
| 58939 | 5/1979 | Japan | 98/49 |
| 935857 | 9/1963 | United Kingdom | 118/326 |

*Primary Examiner*—Harold Joyce
*Attorney, Agent, or Firm*—Louis E. Marn

[57] ABSTRACT

A plurality of air blowers spaced with each other are disposed along a side wall of a clean tunnel, thereby outer air is supplied into a tunnel zone by way of a filter. A clean air produced within the tunnel zone is circulated by disposing air outlets and a suction port in a zone of each blower. Thus, a constant clean air flow can be circulated without raising the temperature of the clean air within the clean tunnel.

5 Claims, 6 Drawing Figures

CLEAN AIR SUPPLY MEANS IN A CLEAN TUNNEL

BACKGROUND OF THE INVENTION

1. Field of the Invention

This invention relates to a clean air supply means in a clean tunnel.

2. Description of the Prior Art

To convey semiconductor wafers or the like by a self-running truck in a clean tunnel, the clean tunnel must be constantly filled with a clean air. In FIG. 5, there is shown a conventional clean air supply means for supplying a clean air into a clean tunnel 1 of a rectangular section.

The clean tunnel 1 is provided with a frame body 2 having an air flow passage 2*k* at its upper end and an air filter 3 thereunder. Any type of air filter having high filtering efficiency may be employed. A plurality of air inlets 4 spaced with each other are disposed along a side wall 2*s* of the air flow passage 2*k*. The air is supplied into the air flow passage 2*k* through the plurality of air inlets 5 by means of an outside air blower (not illustrated). Subsequently, a clean air filtered by the air filter 3 is blown as a laminar layer in a tunnel zone where a travelling rail 5 is laid on a bottom plate 2*b* of the frame body 2. Then, the clean air is discharged from a plurality of air outlets 6, each of which is bored at a center of the bottom plate 2*b* as well as the travelling rail 5. The clean air is discharged by an air discharge blower (not illustrated).

An air supply system of this conventional clean tunnel will be described with reference to FIG. 6.

An air supply blower 7 is provided with a main duct 8 disposed in parallel with the clean tunnel. The main duct 8 has a plurality of subducts 9 communicated with respective air inlets 4. Likewise, an air discharge blower 13 is also provided with a main duct 12 disposed in parallel with the clean tunnel. The main duct 12 has a plurality of subducts 11 communicated with the air outlets 6. Thus, any dust that may occur in connection with driving of a self-running truck 15 can be discharged, together with the clean air, from the plurality of air outlets 6.

The disadvantage of this prior art is that the piping system is of a complicated construction and the clean tunnel itself becomes large-size. In addition, the air flow speed within the tunnel is irregular and the clean air is susceptible to be mixed with dust. Thus, a large quantity of clean air are discharged outside wastefully.

BRIEF SUMMARY OF THE INVENTION

It is a general object of this invention to provide a clean air supply means in a clean tunnel, in which the clean air is circulated by air circulating means, thereby a constant clean air flow is supplied into the clean tunnel without raising the temperature of the clean air.

More specifically, the clean tunnel is provided with the clean air supply means, in which a plurality of air blowers each having a fan are disposed along a side wall of the clean tunnel. The outer air is supplied into the clean tunnel by way of an air supply duct of each blower, while the air within the clean tunnel is discharged from an air outlet disposed adjacent an air suction port of the blower. Thus, the discharged air is sucked by the air suction port, thereby air circulation is carried out. In addition, the clean air supply means is provided with an auxiliary air outlet.

Other and further objects, features and advantages of this invention will appear more fully from the following description taken in connection with the accompanying drawings.

BRIEF DESCRIPTION OF THE ACCOMPANYING DRAWINGS

DETAILED DESCRIPTION OF THE INVENTION

An example of this invention will be described with reference to FIGS. 1 and 2.

Figure 1:
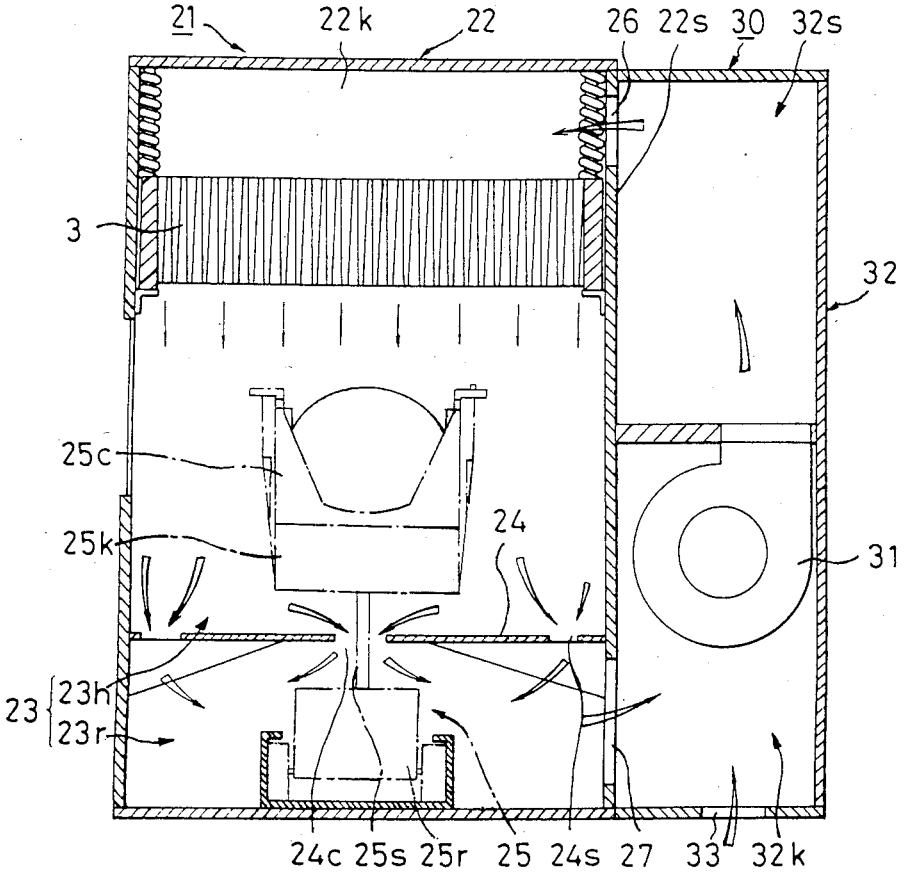
FIG. 1 is a section view of a clean air supply means in a clean tunnel according to one example of this invention.
Figure 2:
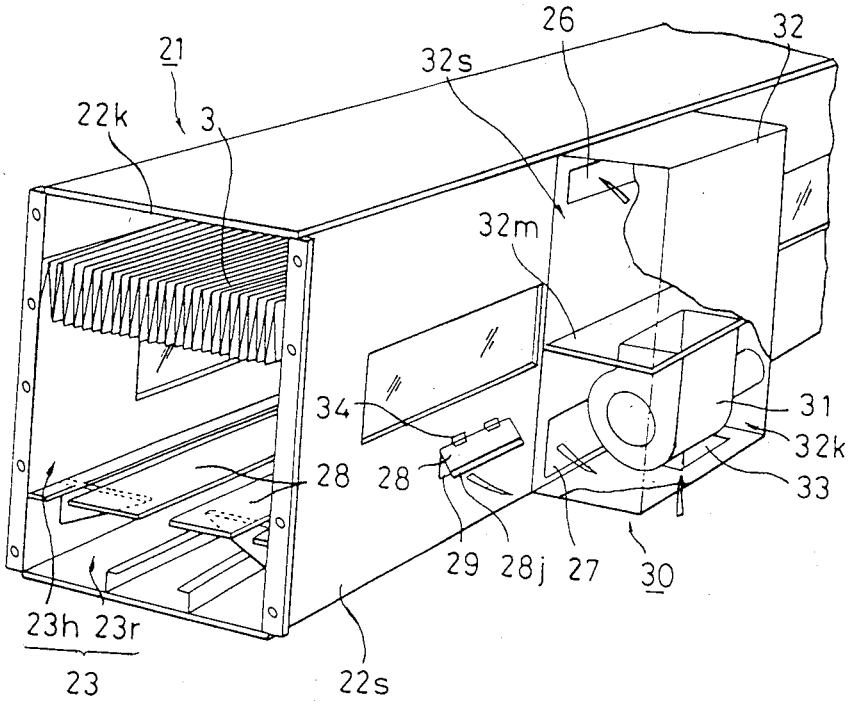
FIG. 2 is a perspective view of the example in FIG. 1.

In FIG. 1, there is shown a clean tunnel 21, in which a tunnel zone 23 consists of a first tunnel zone 23*h* for conveying materials, parts and articles by a self-running truck 25, and a second tunnel zone 23*r* where means 25*r* for driving the truck 25 is disposed.

The self-running truck 25 is provided with a mechanical part 25*k* and a coverless casing 25*c*, both of which are mounted on a column 25*s*. The first tunnel zone 23*h* and the second tunnel zone 23*r* are partitioned by a plurality of separators 24 having a center air opening 24*c* and a pair of side air openings 24*s*. The upper components 25*k* and 25*c* of the truck 25 are fixed with each other by the column 25*s* which passes through the center air opening 24*c*.

A construction of the clean air supply means according to this example will be described.

The clean air supply means comprises the following components:

an air blower 30, an air inlet 26 bored on a side wall 22*s*, an air flow passage 22*k* directly communicated with the air inlet 26, an air outlet 27 in the second tunnel zone, an auxiliary air outlet 29 having a regulating plate 28 and an air filter 3 under the air flow passage 22*k*.

The clean air supply means is provided with a plurality of air blowers 30 spaced with each other along the side wall 22*s* of a frame body 22 of the clean tunnel 21.

The air blower 30 comprises a fan 31, an air supply duct 32*s* and an air suction duct 32*k*. The two ducts 32*s* and 32*k* are partitioned by a partitioning plate 32*m*. The air supply duct 32*s* is communicated with the air inlet 26, while the air suction duct 32*k* is communicated with the air outlet 27. The air suction duct 32*k* is, at its bottom, provided with an auxiliary suction port 33 for sucking air.

The auxiliary air outelt 29 having the regulating plate 28 is disposed along the side wall 22*s* of the first tunnel zone 23*h*. The regulating plate is, on its upper edge, fixed with the side wall 22*s* by means of a pair of hinges 34 and is open outwardly as shown in FIG. 2. Normally, the regulating plate 28 is closed by a weight 28*j* thereof.

When the sectional area of the air inlet 26 is 100, that of the air outlet 27 is preferably 80 and that of the auxiliary air outlet 29 and of the auxiliary suction port 33 is preferably 20.

An operation of the clean air supply means according to this invention will be referred to.

When starting the fan 31, the outer air is supplied into the air flow passage 22*k* by way of the air supply duct 32*s* and the air inlet 26, and filtered by the air filter 3. The filtered air is blown as a clean air laminar layer into the first tunnel zone 23*h* with the air flow speed of 0.5 m per second. The air pressure within the first tunnel zone 23*h* is increased because the air flow is restricted by the plurality of separators 24. When it is higher than the outer air pressure, the clean air within the first tunnel zone 23*h* overcomes a closing force of the regulating plate 28, and tension of the weight 28*j* is released. Then, the regulating plate 28 is open, and a high pressure clean air is discharged from the air outlet 29 with a rate of 20% of the clean air quantity circulating within the first tunnel zone 23*h*.

On the other hand, the most part of the clean air is supplied into the second tunnel zone with the air speed of about 4 m per second by way of the air openings 24*c*, 24*s* formed on the plurality of separators 24.

About 80% of the air quantity discharged from the air outlet 27 is sucked by the suction duct 32*k*. The rest about 20% is outer air which is sucked by the fan 31. In this way, air is circulated, so that such circulating air flow has the function to prevent the increase of temperature and can maintain a constant air flow. Further, it contributes to increase the clean level of air.

Figure 3:
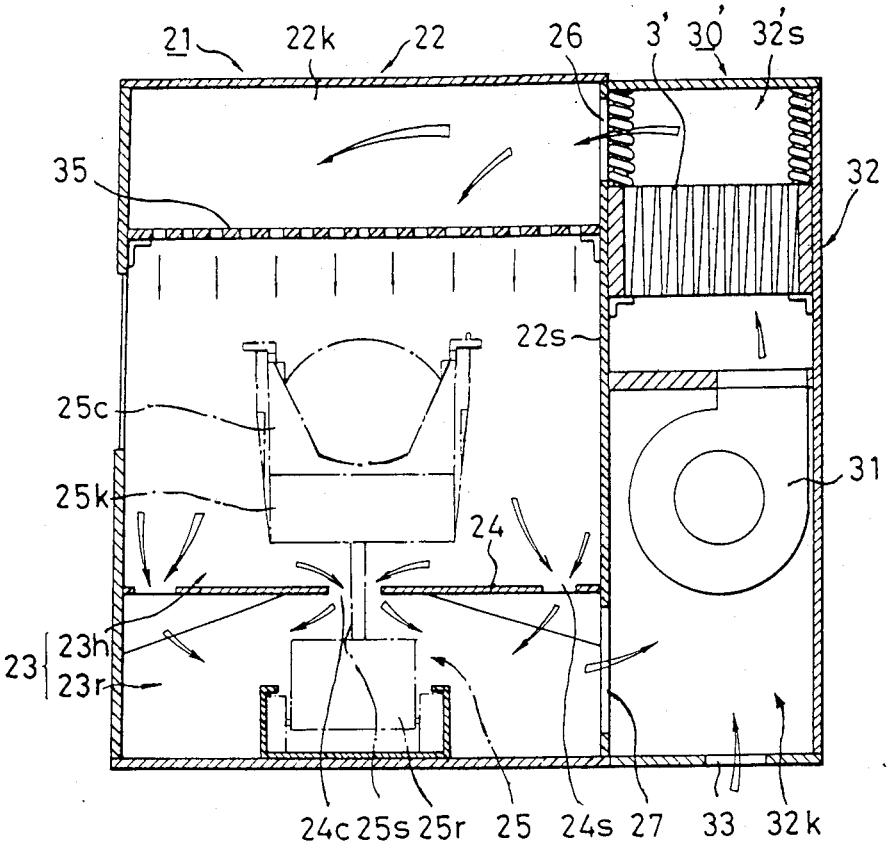
FIG. 3 is a section view of a clean air supply means according to another example of this invention.

Another example of this invention will be described with reference to FIG. 3.

In this example, an air filter 3' is disposed within the air supply duct 32'*s* of an air blower 30'. After the outer air has been filtered by the air filter 3', the filtered clean air is supplied into the air flow passage 22*k* through the air inlet 26. Subsequently, the clean air is blown into the first tunnel zone 23*h* by way of an air regulating plate disposed under the passage 22*k*.

Thus, it is unnecessary to dispose the air filter within the tunnel zone 21, so that the tunnel zone 21 can be made more compact throughout the whole length of it. At the same time, it is possible to save the use of the air filter, and very easy to replace with a new air filter within the air supply duct 32'*s*.

Figure 4:
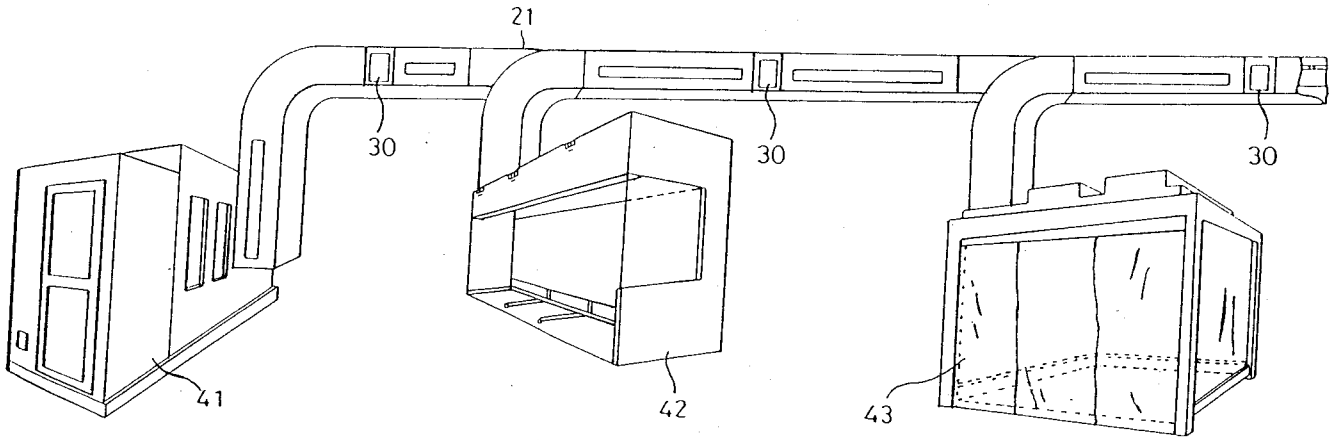
FIG. 4 is a perspective view of a clean tunnel equipped with the clean air supply means of this invention.
Figure 5:
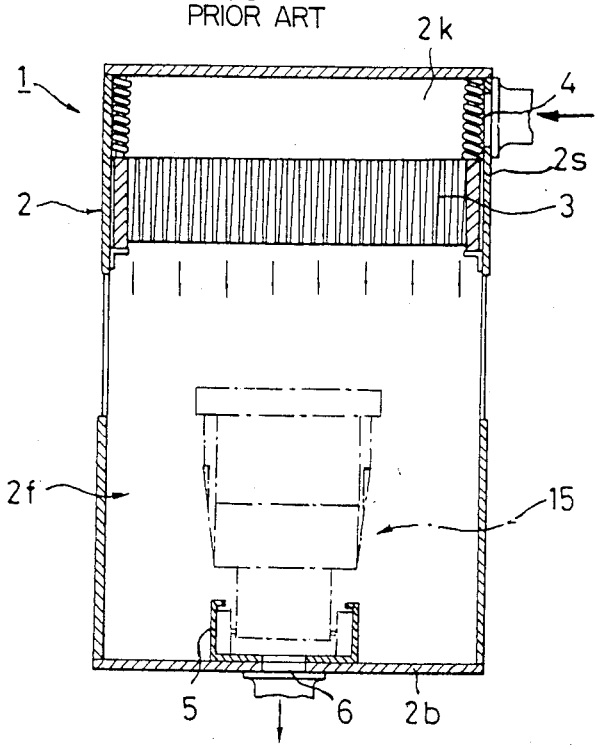
FIG 5 PRIOR ART
FIG. 5 is a section view of a conventional clean tunnel equipped with a known air blower.
Figure 6:
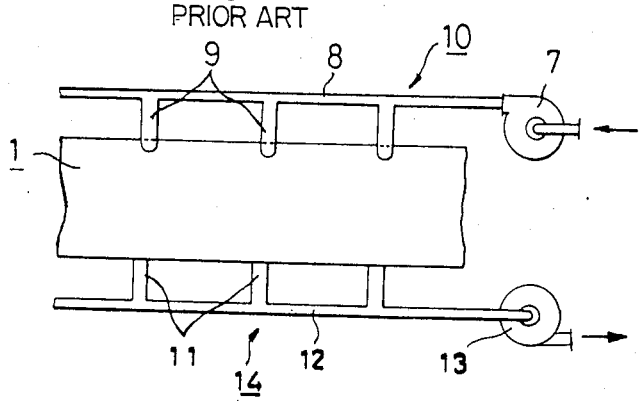
FIG 6 PRIOR ART
FIG. 6 is an air supply and discharge system of the conventional clean tunnel in FIG. 5.

FIG. 4 shows a layout of the clean tunnel 21 equipped with the clean air supply means according to this invention. The clean tunnel 21 is connected to an environmental chamber 41, a line-type clean bench 42 and a clean booth 43.

As described above, a plurality of air blowers spaced with each other are disposed along a side wall of a clean tunnel, thereby outer air is supplied into a tunnel zone by way of a filter means. A clean air produced within the tunnel zone is circulated by disposing air outlets and a suction port in a zone of each blower. Thus, a constant clean air flow can be circulated without raising the temperature of the clean air within the clean tunnel. Further, the clean tunnel can maintain a uniformly clean air throughout the whole length of it. Further, a wasteful discharge of the clean air is prevented, thereby a purification degree of the clean air is enhanced. Still further, it is possible to make compact the whole of a clean tunnel equipped with the clean air supply means of this invention.

While I have shown and described certain embodiment of my invention, it is to be understood that it is capable of many modifications. Changes, therefore, in the construction and arrangement may be made without departing from the spirit and scope of the invention as defined in the appended claims.

What is claimed is:

1. In a clean tunnel having an upper tunnel zone including a conveying assembly and a filter disposed above the conveying assembly and a lower tunnel zone indicating a drive assembly for the conveying assembly, said upper and lower tunnels being partitioned by separator means, a clean air supply assembly comprising:

a plurality of blowers disposed along said clean tunnel;

an air duct in fluid communication with a discharge side of each of said plurality of blowers and with said upper tunnel zone above said filter disposed therein; and an air duct in fluid communication with a suction side of each of said plurality of blowers and with said lower tunnel zone thereby to provide a circulation of clean air within said clean tunnel.

2. The clean air supply assembly for a clean tunnel as defined in claim 1 and further including an auxiliary air outlet disposed in a side wall of said upper tunnel zone for fluid communication with said upper tunnel zone and a regulating plate having a weight hingeably mounted over said auxiliary air outlet.

3. The clean air supply assembly for a clean tunnel as defined in claim 1 and further including an auxiliary air port in fluid communication with said suction side of each of said plurality of blowers.

4. The clean air supply assembly for a clean tunnel as defined in claim 3 wherein a side wall of said tunnel is disposed between said lower tunnel zone and said air duct, said air duct in fluid communication with said suction side of said blower is formed with a lower air port, said lower air port and said auxiliary air port being dimensioned to provide 80 percent of said air flow to said suction side of said blower through said lower air port.

5. The clean air supply assembly for a clean tunnel as defined in claim 1 wherein said separator means include plate members defining a central channel and side channels, said central channel providing access for said conveying and drive assemblies through said clean tunnel.

* * * * *